United States Patent [19]

Hampel et al.

[11] Patent Number: 4,643,114

[45] Date of Patent: Feb. 17, 1987

[54] DEVICE FOR CONTROLLING THE LOOPER THREAD OF A DOUBLE CHAINSTITCH SEWING MACHINE

[75] Inventors: Klaus Hampel, Bielefeld; Wilfried Goldbecker, Steinhagen, both of Fed. Rep. of Germany

[73] Assignee: Kochs Adler AG, Fed. Rep. of Germany

[21] Appl. No.: 742,119

[22] Filed: Jun. 7, 1985

[30] Foreign Application Priority Data

Jun. 28, 1984 [DE] Fed. Rep. of Germany ..... 3423753

[51] Int. Cl.[4] ..... D05B 1/10; D05B 57/02

[52] U.S. Cl. ..... 112/199

[58] Field of Search ..... 112/166, 197, 199, 200, 112/242

[56] References Cited

U.S. PATENT DOCUMENTS

| | | | |
|---|---|---|---|
| 1,949,073 | 2/1934 | Gruman et al. | 112/166 |
| 3,093,821 | 9/1975 | Marforio | 112/242 |
| 4,422,398 | 12/1983 | Dusch | 112/320 |

*Primary Examiner*—Wm. Carter Reynolds

*Attorney, Agent, or Firm*—Laff, Whitesel, Conte & Saret

[57] ABSTRACT

A device for controlling the looper thread of a double chainstitch sewing machine has a looper which can be oscillatingly driven in the sewing direction. A link mechanism is provided to drive the spreader, said link mechanism being designed as a six-bar linkage mechanism with a four-bar linkage and a secondary two-link group. The basic linkage and the two-link group are arranged in such a manner that two links are guided during a movement of the spreader in an extreme position in which it does not spread the looper thread. Thus a spreader movement is produced which is particularly adapted to the sewing process.

5 Claims, 5 Drawing Figures

Fig. 3
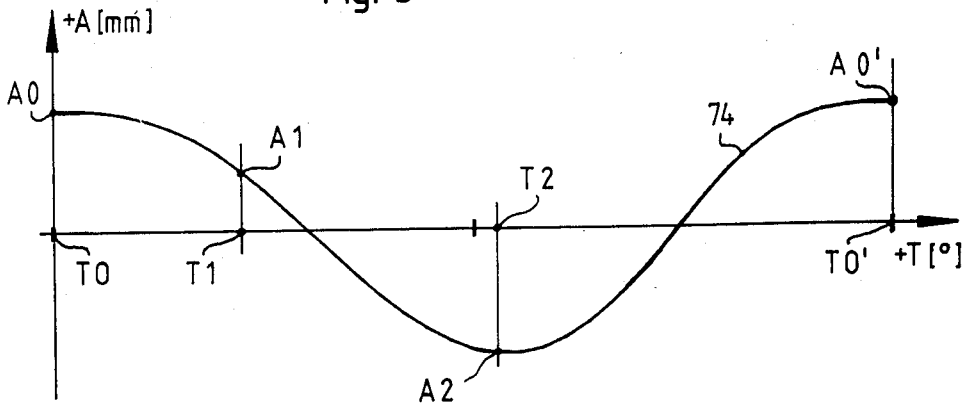
Fig. 5
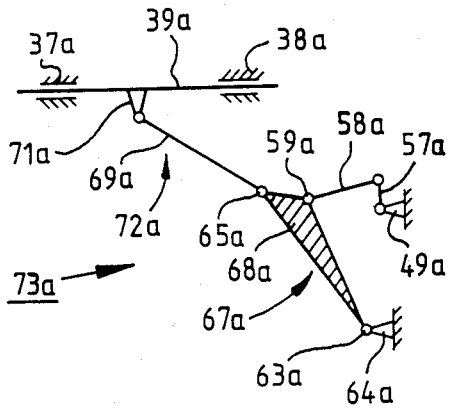
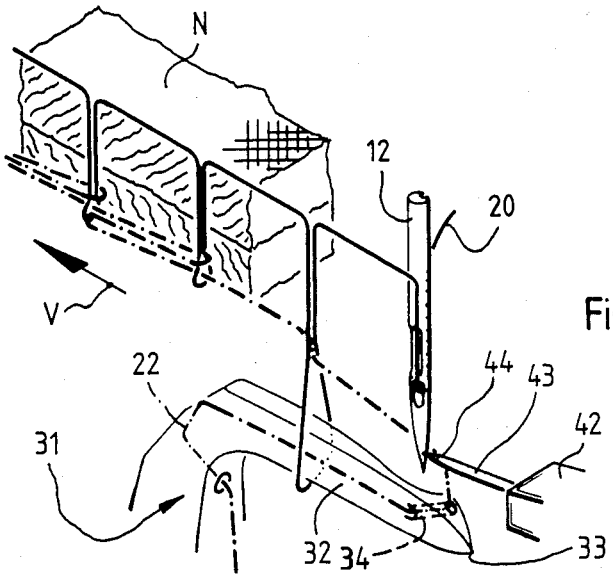
Fig. 4

DEVICE FOR CONTROLLING THE LOOPER THREAD OF A DOUBLE CHAINSTITCH SEWING MACHINE

FIELD OF THE INVENTION

The invention relates to a device for controlling the looper thread of a double chainstitch sewing machine, whose stitch length can be adjusted, with a thread guiding system including a thread delivery, a looper which can be oscillatingly driven in a sewing direction and a looper thread spreader which can be oscillatingly driven perpendicular to the sewing direction by means of a link mechanism.

BACKGROUND OF THE INVENTION

Generally, such devices on double chainstitch sewing machines serve the purpose of controlling the feed and removal of the looper thread to the looper during formation of the stitch. The spreader has the task of diverting to the side or pulling out the thread which protrudes out of the looper point and runs upwards to the stitch hole so that the descending point of the needle can move past between said thread and the looper. At this moment the looper thread should be slightly tensioned so that the so-called insertion movement, i.e. the insertion of the point of the needle into the thread triangle, two sides of which are formed by the needle thread and the other side by the looper thread, is accurately achieved.

Machines of this type are often equipped with a feeding device for the material to be sewn, the transport taking place at the same time as the needle penetrates the material. Such feeding devices are, for example, described in the German Offenlegungsschrift No. P34 11 217.0 corresponding to U.S. patent application Ser. No. 06/702,038. With such so-called needle-transport sewing machines the needle adopts different positions for different stitch lengths when it enters the thread triangle formed with the aid of the spreader, i.e. during the insertion movement, such a measure reducing the insertion accuracy especially with larger stitch lengths of 6 and more millimetres. After the insertion operation the spreader must not hinder the looper thread in any way when the latter is withdrawn from the spreader through the looper movement.

The procedure described above results in certain demands being placed on the sequence of movements of the spreader while it is acting on the looper thread. The remaining sequence of movements of the spreader, which lies inactive immediately adjacent to the looper, must be designed in such a way that a collision with the looper is absolutely precluded.

Furthermore, it is also desirable for the short-time action of the spreader on the under thread to be achieved by a spreader movement which exhibits a small amplitude and which thus permits another looper to be arranged at the smallest possible distance from the first looper so that parallel stitches can also be made.

A device of the generic type is known from a publication of Pfaff, Kaiserslautern, Federal Republic of Germany, "PFAFF adjusting instructions Pfaff 5642, No. 296-12-13 924". According to this publication the spreader is driven by a link mechanism which only satisfies the requirements placed on the movements of the spreader to a limited extent. In order to produce stitches with a maximum stitch length of 6 mm, spreaders whose points are bent are provided. These measures have an influence on the release of the looper thread and serve to compensate for inadequacies in the sequence of movements of the spreader. In addition to these spreaders, which are to be adjusted with great care, this device is also designed to control the looper thread with thread eyes in the thread delivery zone, said thread eyes adopting different positions in relation to each other depending on the set stitch length. These thread eyes can be adjusted for work with threads of different elasticity. The device is not suitable for influencing stitch formation to such an extent as to achieve an accurate stitch formation and good stitch tightening for stitch lengths which are considerably longer than 6 mm as well.

SUMMARY OF THE INVENTION

An object of the invention is to provide a device for controlling the looper thread of a double chainstitch sewing machine which has a simple design, is easy to handle and fulfils the afore-mentioned sewing requirements.

This object is solved according to the invention by designing the link mechanism as a six-link mechanism with three bearings said link mechanism consisting of a basic four-bar linkage and a secondary two-link group whereby two links are guided during a movement of the spreader in an extreme position in which it does not spread the looper thread.

The result of this measure is that the spreader is imparted a movement in which the spreading procedure takes place in a relatively short time. The spreader moves relatively quickly during the spreading, considerably decelerated during an inactive phase and almost at a standstill in its extreme position. The device according to the invention permits the use of spreaders with a simple design and dispenses with the need for displacement of the thread-guiding elements despite larger stitch lengths. When the links of the link mechanism are in the extreme position, this can either be a stretched or a covering position.

Furthermore, through the invention a connection of the spreader with the link mechanism exhibiting very little play is achieved. The invention permits the use of link elements which can be manufactured very accurately and cheaply. The design of the thread delivery disc as an axial groove brings the advantage of a space-saving design.

Further advantages and features of the invention will become apparent from the following description of a preferred embodiment and the accompanying drawings.

BRIEF DESCRIPTION OF THE DRAWINGS

FIG. 3 is a diagram showing the sequence of motion of the spreader dependent on the angle of rotation of the drive;

FIG. 4 is a schematic perspective view according to the arrow IV in FIG. 1, showing the stitch forming procedure of a double chainstitch seam and FIG. 5 is a schematic representation of the device according to the invention illustrated as a kinematic linkage.

DESCRIPTION OF THE PREFERRED EMBODIMENT

Figure 1:
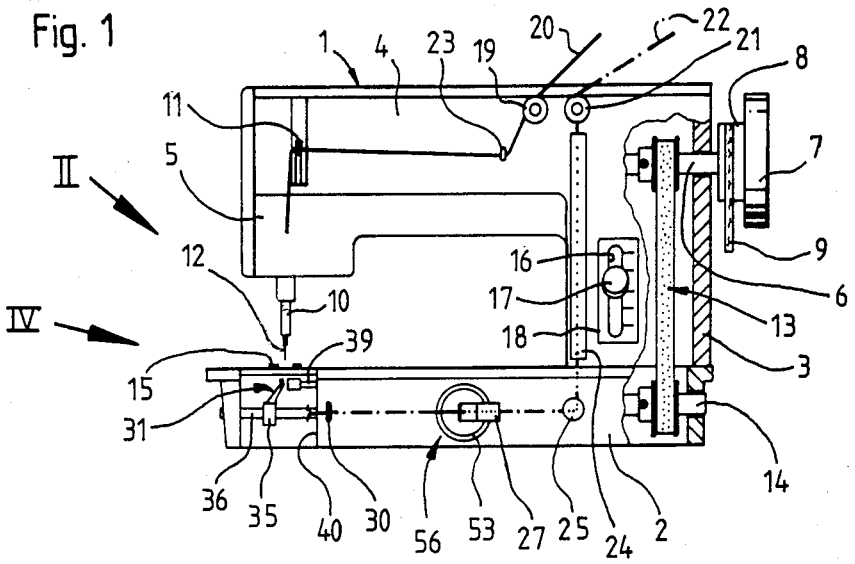
FIG. 1 is a front view of a double chainstitch sewing machine.

In the drawings a sewing machine 1 is illustrated provided with a base plate 2, to one end of which is secured an upwardly extending standard 3. The standard 3 is formed with arm 4 extending parallelly with respect to the base plate 2 and terminating in a head 5. In the arm 4 an arm shaft 6 is pivoted one end of which projects through the standard 3 for receiving a handwheel 7 with a belt pulley 8 fastened to the latter. The belt pulley 8 is connected via a belt 9 to the drive of the sewing machine 1. The other end (not illustrated) of the arm shaft 6 terminates in the head 5 and is provided in the usual manner with a not shown crank for reciprocatingly driving a needle bar 10 and a thread take-up lever 11 via not shown elements. The needle bar 10 is displaceably received in a not shown needle bar jogging frame, which is oscillatingly driven by not shown elements in and oppositely to the sewing resp. feeding direction V. The lower end of the needle bar 10 is provided with a needle 12.

The arm shaft 6 is pivotally connected via a timing belt drive 13 (gear ratio 1:1) to a shaft 14, which is pivoted in the base plate 2. Inside of the standard 3 and the base plate 2 a not shown feeding device is provided, which, in the area of the needle 12, is drivingly connected to a feed dog 15. Such a feeding device is for instance described in German Offenlegungsschrift No. P 34 11 217.0. According to FIG. 1 the front surface of the standard 3 is formed with an opening 16, through which projects an adjusting lever 17 for altering the feeding increment of the feed dog 15. Adjustment of the adjusting lever 17 is readable from a scale 18.

At the front surface of the standard 3 a thread tensioner 19 for a needle thread 20 and a thread tensioner 21 for a looper thread 22 are provided. The needle thread 20 and the looper thread 22 each are supplied to the sewing machine 1 by a thread spool. After passing the thread tensioner 19, the needle thread 20 is led via a thread guide 23 located at the front surface of the arm 4, to the thread take-up lever 11 and then to the needle 12. after passing the thread tensioner 21, the looper thread 22 passes a thread guide canal 24 located at the front surface of the standard 3 and terminating shortly before reaching the base plate 2. In this area the base plate 2 is formed with a not shown opening for the passage of the looper thread 22 until reaching a thread eye 25. By the aid of the thread eye 25 the looper thread 22 is guided from its vertically extending direction into a horizontally extending direction and then is received by a thread eye 26. The thread eye 26 is part of an S-shaped thread guide 27 which, in addition to the thread eye 26 is provided with an intermediate thread eye 28 and a further thread eye 29.

From the thread eye 29 the looper thread 22 extends through a further eye 30 formed at the base plate 2, and finally to a double chainstitch looper 31. According to FIG. 4, the looper 31 is formed with a looper blade 32 extending oppositely to the feeding direction V. The free end of the looper blade 32 forms a looper point 33. Furthermore, the looper blade 32 is provided with a not shown U-shaped groove for guiding the looper thread 22 until leaving a bore 34 in the area of the looper point 33.

The looper 31 is connected via a carrier 35 to a shaft 36, which extends parallelly with respect to the shaft 14 and is pivoted in the base plate 2. Within the base plate 2 a not shown gear is provided for oscillatingly driving the looper 31. This gear is drivingly connected to the shaft 14.

Figure 2:
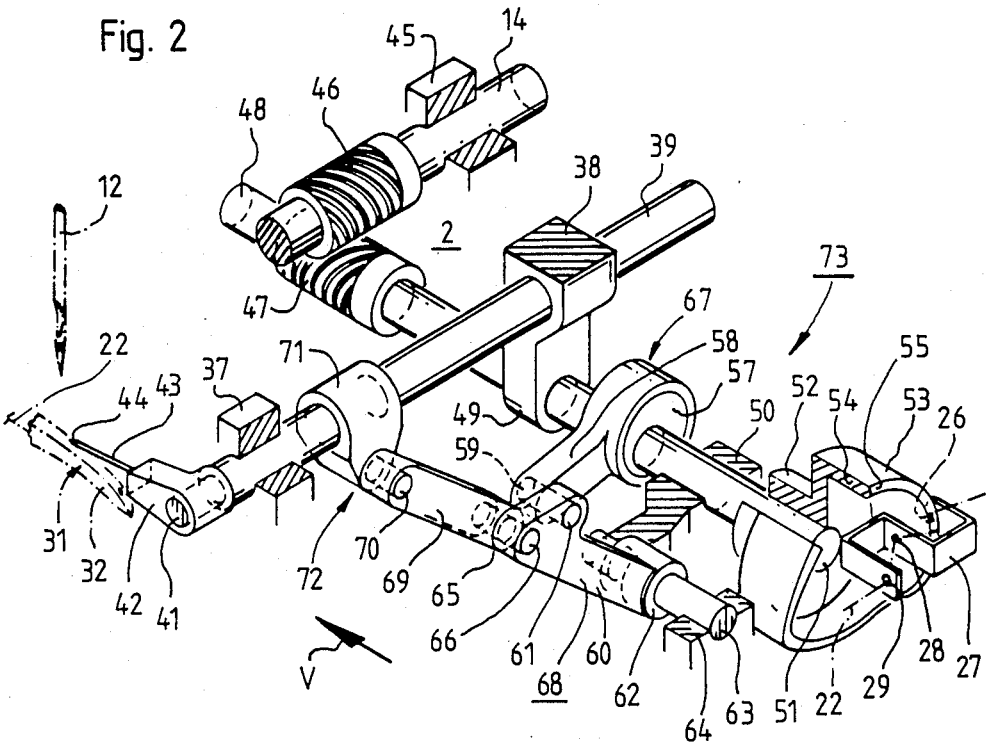
FIG. 2 is a perspective view according to the arrow II in FIG. 1, showing essential components of the device according to the invention.

According to FIG. 2 a connecting rod 39 is displaceably received in bearings 37, 38 situated in the base plate 2. The connecting rod 39 extends parallelly with respect to the shafts 36, 14. Just as the shaft 36, the connecting rod 39 projects from the central area of the base plate 2 through a wall 40 into the working area of the needle 12. The connecting rod 39 is formed with an off-set end 41, to which is secured a lever 42. The lever 42 extends in feeding direction V and is tilted slightly downwards with respect to the horizontal line. From the free end of the lever 42 projects a spreader 43, which is made from elastic wire and terminates in a tip 44. The spreader 43 extends substantially linearly above the looper 31 and its tip 44 terminates in the area of the needle 12 as viewed in feeding direction V.

In FIG. 2 a part of the shaft 14 is illustrated, which is supported in a bearing 45 of the base plate 2 and is provided with a driving spiral gear 46. The spiral gear 46 meshes with a driven spiral gear 47, which is secured to a cross shaft 48 extending rectangularly with respect to and below the shaft 14. The two spiral gears 46, 47 are formed so as to have a gear ratio of 1:1.

The cross shaft 48 is pivoted in a bearing 49 connected to the bearing 38, and a bearing 50 of the base plate 2. To the end 51 of the cross shaft 48 turned away from the spiral gear 47 a hub 52 of a thread delivery disc 53 is fastened. The thread delivery disc 53 is provided with a coaxial casing 54 the rounded-off front surface of which is profiled in longitudinal direction of the cross shaft 48 so as to form a cam surface 55. The casing 54 projects into the U-shaped area of the thread guide 27 provided with the thread eyes 26, 28. The guiding elements of the looper thread 22 comprising the thread tensioner 21, the thread guiding canal 24, the thread eye 25, the thread guide 27 with the thread eyes 26, 28, 29, the eye 30 and the thread delivery disc profiled with the cam surface 55, are denoted as thread guiding system 56.

According to FIG. 2 the cross shaft 48 is provided between the bearings 49, 50 with an eccentric 57, embraced by a collar of a tie rod 58. A pivot pin 59 is pressed into the free end of the tie rod 58 for rotatably receiving a lever 60, which form a joint 61. The lever 60 supports rotatably via a bearing 62 on a bolt 63. The bolt 63 is secured in a bearing 64 of the base plate 2 . The lever 60 extends transversely with respect to the cross shaft 48, i.e. the bolt 63 extends parallelly with respect to the cross shaft 48. Adjacent and in parallel with respect to the joint 61 of the lever 60 is provided a joint 65 for rotatably receiving a pivot pin 66. The assembly of elements comprising the bearings 50, 64, the bolt 63, the eccentric 57, the tie rod 58 with its pivot pin 59, and the lever 60 with its joint 61 and the bearing 62, forms a basic four-bar linkage 67, at which the lever 60 in conjunction with its bearing 62 and its joints 61, 65 forms an off-drive bar 68 in the kind of a triangular lever.

The pivot pin is fixedly connected to one end of a lever 69, the other end of which rotatably receives a bolt 70. The bolt 70 is a part of a connecting piece 71 fixedly connected to the connecting rod 39. As viewed in the sense of gear technology, supporting of the connecting rod 39 in the bearings 37, 38 creates an arrangement, which has the function of an endless lever pivoted in the base plate 2. Insofar, this imaginary lever formed by the bearings 37, 38 and the connecting rod 39 with the connecting piece 71 and the bolt 70, forms in conjunction with the lever 69 a two-link group 72. All elements of the basic four-bar linkage 67 and the two-link group 72 coupled thereto, form a six-bar linkage mechanism 73. At this, the two-link group 72 and the basic four-bar linkage 67 are arranged so that the lever 69 and the lever 60 together with its bearing 62 and the joint 65 are moved by the eccentric 57 into an almost stretched position when the spreader 43, as viewed in feeding direction V, takes in its left extreme position.

In FIG. 5, in principle, the construction of the gear according to FIG. 2 is illustrated as a kinematic linkage, at which the corresponding elements are denoted with the same reference numbers, however, with an "a" added. Moreover, as obvious from FIG. 5, the connecting rod 39*a* is hingedly connected via the lever 69*a* to the off-drive bar 67*a*. Thus, the movement of the connecting rod 39*a* is derived from the link 65*a*, which is moved on a circular arc segment.

Operation of the device for controlling the looper thread is as follows:

As a result of the drive of the arm shaft 6 the needle bar 10 including the needle 12 and the thread take-up lever 11 moves up and down. The shaft 14 moves through the same angle via the timing-belt drive 13. In accordance with the setting of the adjusting lever 17 the rotating movement of the shaft 14 of the feeding device imparts a rectangular movement to the feed dog 15. The latter movement, in conjunction with a standard hold down which is not illustrated causes the material N to be sewn to be advanced in a sewing feeding direction V.

During these movements an oscillating movement in and against the feeding direction V is also superimposed on the needle bar 10 moving up and down in such a way that the material to be sewn N is always advanced when the needle 12 has penetrated the material to be sewn N. The needle 12 enters the stitch hole provided in the feed dog 15. The above described interaction of the needle 12 and the feed dog 15 during the sewing operation is generally known from so-called needle-transport sewing machines.

Through the rotating movement of the shaft 14 the cross shaft 48 acting as a drive shaft for the eccentric 57 is driven in a rotating movement via the spiral gears 46, 47 whereby the speed of the cross shaft 48 corresponds to the speed of the arm shaft 6 owing to the 1:1 ratio of the spiral gears 46, 47 and the timing belt drive 13. Oscillating movements are transferred from the eccentric 57 driven by the cross shaft 48 to the off-drive bar 68 via the tie rod 58 and the pivot pin 59. During this process the lever 60 describes an oscillating motion which is then transferred via the pivot pin 66 to the lever 69 which in turn moves the connecting rod 39 to and fro perpendicular to the feed direction V via the connecting piece 71. As a result of this to-and-fro movement of the connecting rod 39 the spreader 43 also describes an oscillating motion perpendicular to the sewing or feeding direction V, said motion having the same frequency as the movements of the looper 31, the needle bar 10 with needle 12, the thread take-up lever 11 and the feed dog 15.

As the cross shaft 48 rotates, the thread delivery disc 53 also rotates whereby the groove 55 of the casing 54 acts on the looper thread 22 led between the thread eyes 26, 28 and lying in contact with the groove 55. In doing so, the thread delivery disc 53 causes another looper thread 22 to be pulled off the thread bobbin or the looper thread 22 to remain unaffected or the looper thread to be released or the latter to be withdrawn from the looper 31.

In FIG. 3 the movement A of the spreader 43 is represented by the curve 74 in relation to the angle of rotation T of the shaft 14 or the cross shaft 48. As can be seen from the path of the curve 74, the oscillating movement of the spreader 43 commences in said spreader's extreme position A0, in which the linkage mechanism 73 adopts its stretched position, where the spreader 43 thus adopts a prolonged standstill position. At this moment the cross shaft 48 adopts the angle of rotation T0. After an angle of rotation T1 of approximately 90° has been described, whereby the spreader 43 is only minimally displaced from its extreme position A0, the looper thread 22 is touched by the spreader 43 at a point in time when the latter has adopted a position according to A1. In the further course of the sequence the spreader 43 follows the path of the curve 74 until the moment of the so-called insertion operation, i.e. the penetration of the descending needle 12 into the triangle of thread formed on two sides by the needle thread 20 and on the other side by the looper thread 22. This moment is defined so that the point of the needle 12 is positioned on a lever with the top of the looper blade 32 as illustrated in FIG. 4. According to the path of the curve 74 the cross shaft 48 has now adopted an angle T2 whereby T2 is about 180° corresponding to the reversing point of the spreader 43.

FIG. 3 shows that the spreader 43 acts for a relatively short period on the looper thread 22. The spreader 43 describes 70–80% of its swing-out movement through an angle of rotation of about only 90°. In the further path of the curve the spreader 43 executes an inactive movement whereby said spreader returns at a decelerated rate without any contact with the looper thread 22 in accordance with the remaining path of the curve 74 to its extreme position A0' corresponding to the angle of rotation T0' of the cross shaft 48. Owing to the movement of the spreader 43 in accordance with the path of the curve 74 spreader movements which are favourable to the sewing operation are achieved over a relatively wide range of stitch lengths. The decelerated and accelerated movement sequences of the spreader 43 on the one hand lead to a space-saving oscillating amplitude and on the other hand provide the possibility of keeping the looper thread 22 tensioned through a corresponding design of the thread delivery disc 53 via the angle of rotation or the time period T1 to T2 during which the spreader 43 acts. Thus the insertion accuracy is further increased.

What is claimed is:

1. A device for controlling the looper thread of a double chainstitch sewing machine, whose stitch length can be adjusted with a needle and with a thread guiding system including a thread delivery for a needle thread and for a looper thread, a looper which can be oscillatingly driven in a sewing direction and a looper thread spreader which can be oscillatingly driven perpendicular to the sewing direction by means of a link mechanism for spreading a triangle of thread formed by the needle thread and the looper thread when said needle penetrate into said triangle of thread, wherein said link mechanism is a six-link mechanism with three bearings, said link mechanism consisting of a basic four-bar linkage and a secondary two-link group whereby two links are guided during a movement of said spreader in an extreme position in which it does not spread said looper thread whereby the looper thread spreader is almost at a standstill in the said extreme position.

2. A device according to claim 1 wherein said link mechanism is an even six-bar linkage mechanism with a drive shaft which can be driven in a rotating motion and runs parallel to said sewing direction.

3. A device according to claim 2 wherein said thread delivery includes a thread delivery disc located on one end of said drive shaft opposite to said sewing direction.

4. A device according to claim 3 wherein said thread delivery disc has a coaxial cam surface running in the axial direction of said thread delivery disc.

5. A device according to claim 1 wherein the basic four-bar linkage includes an off-drive bar, one end of which being rotatably received in one of said three bearings, the other end of which being connected by a joint to said secondary two-link group.

* * * * *